United States Patent [19]

Metrick

[11] Patent Number: 4,803,820

[45] Date of Patent: Feb. 14, 1989

[54] TAPE FOR SEALING GLAZING UNIT

[75] Inventor: Stanley G. Metrick, Don Mills, Canada

[73] Assignee: AFG Glass Inc., Willowdale, Canada

[21] Appl. No.: 171,445

[22] Filed: Mar. 21, 1988

[51] Int. Cl.[4] ..... E04B 1/62

[52] U.S. Cl. ..... 52/397; 52/511; 52/400

[58] Field of Search ..... 52/208, 397, 398, 399, 52/400, 415, 416, 417, 420, 511, 764, 788

[56] References Cited

U.S. PATENT DOCUMENTS 2,834,999 5/1958 Taylor et al. ..... 52/398 X 3,971,178 7/1976 Mazzoni et al. ..... 52/399 X

*Primary Examiner*—David A. Scherbel

*Assistant Examiner*—J. Johnson

*Attorney, Agent, or Firm*—Sim & McBurney

[57] ABSTRACT

A glazing unit is sealed into an extruded frame member by utilizing a piece of sealing tape which is impervious to air and water and which is disposed in sealing relation to the glazing unit. The tape is divided intermediately into a first portion adjacent one edge and a second portion adjacent the other edge, the first tape portion having adhesive on one surface, and the second tape portion having adhesive on the other surface. The first tape portion is adhered to a flat part of the extruded frame member adjacent the glazing unit with the adhesive surface away from the glazing unit. The second tape portion extends substantially at right angles with respect to the first, and is adhered to the inner pane of the glazing unit.

4 Claims, 2 Drawing Sheets

TAPE FOR SEALING GLAZING UNIT

This invention relates generally to glazing for use in buildings, and has to do particularly with a sealing tape adapted to provide an improved air and liquid seal around a glazing unit.

GENERAL DESCRIPTION OF THIS INVENTION

Heretofore, glazing units (consisting of two or more panes of glass with spacing means between them) have been sealed against the entry of air and water by resilient sealing elements between which the glazing unit is sandwiched under pressure. The present invention proposes to replace the sealing function of such sealing elements with a specially constructed tape. The tape thus takes over the sealing function but has no structural or supportive role to play in the structure. Sealing elements continue to be utilized in the construction according to this invention, but the sealing elements perform essentially the supportive or structural role, and do not need to provide as reliable a sealing function as heretofore.

More particularly, this invention provides, in combination:

a glazing unit which includes parallel outer and inner panes, and an intermediate spacing means between the outer and inner panes, the unit having rectilinear edges, a frame member which includes a first flat portion perpendicular to the planes of the panes and running parallel to one of said edges, and includes a second flat portion that is perpendicular to said first flat portion and in a plane parallel to the planes of the panes, a seal member between the second flat portion and one of the panes, and a piece of sealing tape impervious to air and water disposed in sealing relation with respect to the glazing unit, the tape having parallel side edges and being divided intermediately into a first portion adjacent one edge and a second portion adjacent the other edge, the first tape portion having adhesive on one surface of the tape and the second tape portion having adhesive on the other surface of the tape, said first tape portion being adhered to said first flat portion of the frame member adjacent the glazing unit, with the adhesive surface away from the glazing unit, said second tape portion extending substantially at right angles with respect to the first tape portion and being adhered to one pane of the glazing unit, and means for clamping the glazing unit against said seal member.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
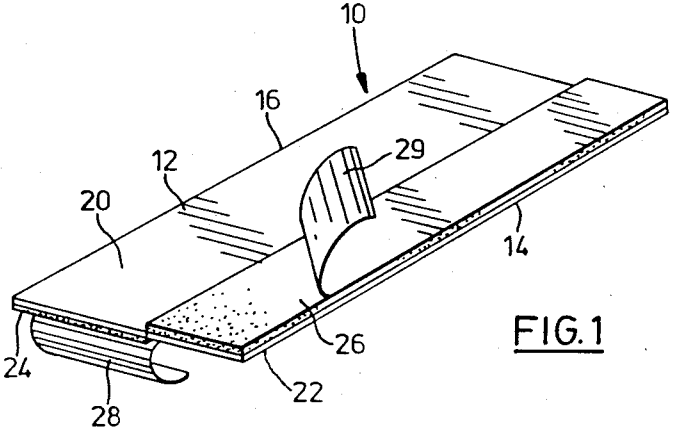
FIG. 1 is a perspective view of a length of sealing tape constructed in accordance with this invention.

Attention is first directed to FIG. 1, which shows a sealing tape 10 consisting of a strip 12 of suitable material, the strip 12 having parallel side edges 14 and 16. The tape 10 is divided intermediately into a first portion 20 adjacent the edge 16, and a second portion 22 adjacent the edge 14. The first tape portion 20 has an adhesive layer 24 on the undersurface of the tape 12, while the other tape portion 22 has an adhesive layer 26 on the upper surface of the tape 12. Prior to use, the tape 10 could have applied to it two protective, removable strips 28 and 29, covering the adhesive layers 24 and 26.

Figure 2:
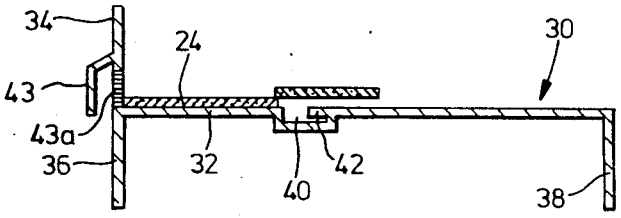
FIGS. 2, 3 and 4 are sequential sectional views through an extruded frame member, illustrating one way to apply the tape of FIG. 1.

Turning to FIG. 2, there is shown an extruded frame member 30 which includes a first flat portion 32 and an outer ledge 34 constituting a second flat portion. The frame member 30 also includes a downwardly projecting ledge 36 on the outside, and a further downwardly projecting ledge 38 on the inside. ("Outside" refers to the outside of a building with which this invention is to be used, and is to the left in FIG. 2.)

Intermediate the flat portion 32, the frame member defines a locking groove 40 with a leftwardly projecting rib 42. Projecting obliquely outwardly then downwardly from the outer ledge 34 is a protective skirt 43 which protects a plurality of spaced-apart drainage holes 43*a*.

Figure 3:
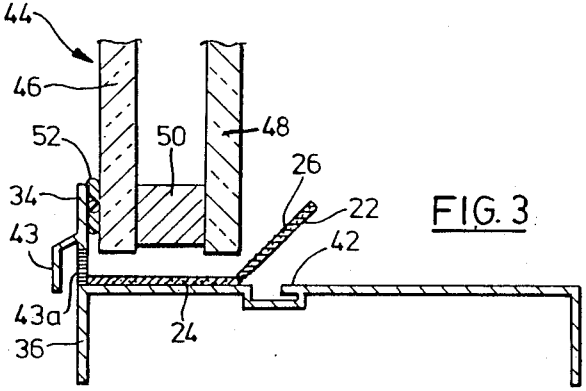

The first step in the application of the tape 10 is to remove the protective covering 28 from the adhesive layer 24, and to adhere that layer against the first flat portion 32 of the frame member 30, in abutting relation with the ledge 34. Next, a glazing unit 44 is positioned against the frame member 30 with setting blocks (not shown) at the bottom. In FIG. 3, the glazing unit 44 is seen to include parallel outer and inner panes 46 and 48, and an intermediate spacing means 50 of conventional construction between the outer and inner panes 46 and 48.

With the glazing unit in place, the protective covering material is removed from the adhesive layer 26, and the second tape portion 22 is then bent upwardly at right angles to lie against the inner pane 48 and be adhered thereto. FIG. 3 shows the second tape portion 22 at an intermediate angle prior to adherence to the inner pane 48.

Figure 4:
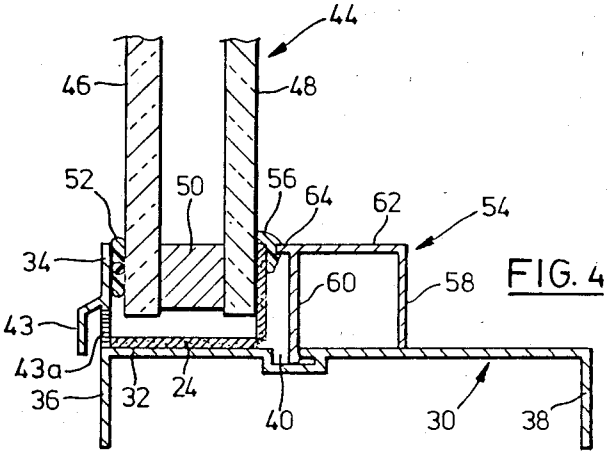

FIGS. 3 and 4 show a seal member 52 between the outer ledge 34 and the outer pane 46.

When the tape 10 has been put into position as previously described, a glass stop 54 of a conventional nature is locked into the groove 40 using the rib 42, and presses leftwardly against a further seal member 56. The further seal member 56 presses leftwardly against the glazing unit 44, thus urging the same against the seal member 52.

As can be seen, the glass stop 54 includes two vertical walls 58 and 60, and a top wall 62 having a leftwardly projecting lip 64. The locking means for the glass stop 54 is at the bottom of the vertical leg 60.

It will thus be appreciated that the tape 10 assumes a large part if not all of the sealing function previously provided by the seal 52. Thus deterioration of the seal member 52 over time does not necessarily result in ingress of air or water past the glazing unit 44.

A suitable material for the ribbon 12 of tape is aluminum foil, although it will be understood that any material capable of resisting the passage of air and water, and having sufficient flexibility, would be suitable.

Figure 5:
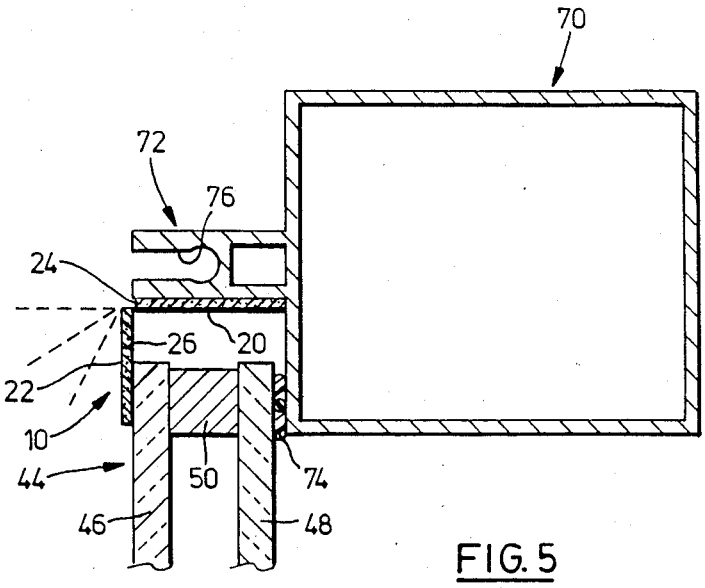
FIG. 5 illustrates a different construction in which the tape can be used.

FIG. 5 shows an extruded vertical mullion 70 of rectangular configuration in cross-section, having an outwardly projecting portion 72 running parallel with a vertical edge of the glazing unit 44. In this configuration, the sealing tape 10 is applied by first removing the protective strip 28, then adhering the adhesive layer 24 against the outwardly projecting portion 72 of the vertical mullion 70. After the glazing unit 44 has been put into place with a suitable sealing element 74, the other portion 22 is swung down so that a portion thereof contacts the outer pane 46 of the glazing unit 44. Typically, a further protective cap portion (not shown in FIG. 5) is applied to cover and protect the portion 22 of the tape 10, the cap being received in and held in place by a vertical channel 76 in the outwardly projecting portion 72 of the vertical mullion 70.

Figure 6:
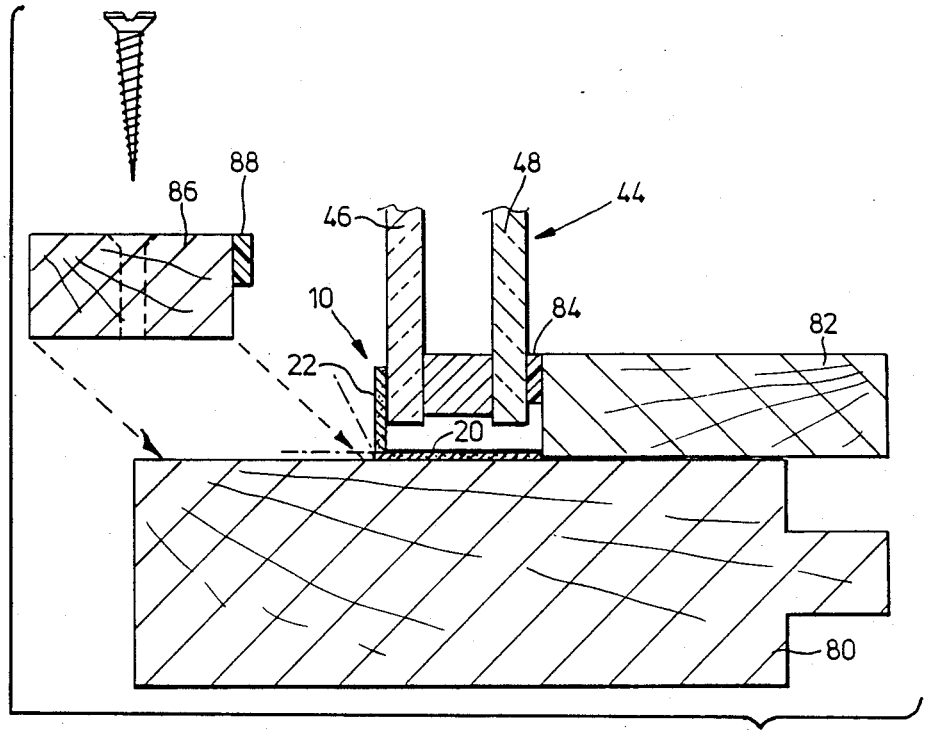
FIG. 6 illustrates yet a further construction in which the tape can be used.

FIG. 6 shows another configuration in which the sealing tape 10 can be used. In this embodiment, the frame for the glazing unit 44 is constructed of wood pieces. A first main frame member 80 is put into place in the window frame, following which a smaller member 82 is fastened into place. The sealing tape 10 is located as shown, with the portion 20 adhered down against the upper surface of the member 80. After the glazing unit 44 has been put into place and held firmly against a seal member 84 in contact with the member 82, the portion 22 of the sealing tape 10 is bent upwardly at right angles and adhered against the outer pane 46 of the glazing unit 44. Following this procedure, a further block 86 is screwed into place against the member 80. Between the block 86 and the outer surface of the portion 22 of the sealing tape 10, there is provided a further seal 88.

While one embodiment of this invention has been illustrated in the accompanying drawings and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. In combination:

a glazing unit which includes parallel outer and inner panes, and an intermediate spacing means between the outer and inner panes, the unit having rectilinear edges, a frame member which includes a first flat portion perpendicular to the planes of the panes and running parallel to one of said edges, and a second flat portion that is perpendicular to said first flat portion and in a plane parallel to the planes of the panes.

a seal member between the second flat portion and one of the panes, and a piece of sealing tape impervious to air and water disposed in sealing relation with respect to the glazing unit, the tape having parallel side edges and being divided intermediately into a first portion adjacent one edge and a second portion adjacent the other edge, the first tape portion having adhesive on one surface of the tape and the second tape portion having adhesive on the other surface of the tape, said first tape portion being adhered to said first flat portion of the frame member adjacent the glazing unit, with the adhesive surface away from the glazing unit, said second tape portion extending substantially at right angles with respect to the first tape portion and being adhered to one pane of the glazing unit, and means for clamping the glazing unit against said seal member.

2. The invention claimed in claim 1, in which said means for clamping includes a removable member adapted to interlock with said frame member adjacent one pane of the glazing unit, and a further seal member between the removable member and the other pane.

3. The invention claimed in claim 2, in which the tape is of aluminum.

4. The invention claimed in claim 1, in which the tape is of aluminum.

* * * * *